US006422185B1

(12) United States Patent
Duesmann et al.

(10) Patent No.: US 6,422,185 B1
(45) Date of Patent: Jul. 23, 2002

(54) METHOD FOR OPERATING A PISTON-TYPE INTERNAL-COMBUSTION ENGINE IN THE EVENT OF A TEMPORARY FUNCTIONAL FAILURE OF AN ELECTROMAGNETIC VALVE TRAIN

(75) Inventors: Markus Duesmann, Stolberg; Wolfgang Salber; Hans Kemper, both of Aachen, all of (DE)

(73) Assignee: FEV Motorentechnik GmbH, Aachen (DE)

( * ) Notice: Subject to any disclaimer, the term of this patent is extended or adjusted under 35 U.S.C. 154(b) by 0 days.

(21) Appl. No.: 09/694,298

(22) Filed: Oct. 24, 2000

(30) Foreign Application Priority Data

Oct. 25, 1999 (DE) ..... 199 51 315

(51) Int. Cl.[7] ..... F01L 9/04

(52) U.S. Cl. ..... 123/90.11; 123/90.15; 123/90.16; 123/198 D; 251/129.1

(58) Field of Search ..... 123/90.11, 90.15, 123/90.16, 188.1, 198 D, 198 DB, 198 DC; 60/273, 274; 251/129.01, 129.1; 335/256, 251

(56) References Cited

U.S. PATENT DOCUMENTS 5,596,956 A * 1/1997 Ogawa et al. ..... 123/90.11
5,775,278 A * 7/1998 Moriya et al. ..... 123/90.11
5,791,305 A * 8/1998 Kather et al. ..... 123/90.11
5,797,360 A * 8/1998 Pischinger et al. ..... 123/90.11
5,799,926 A * 9/1998 Moriya et al. ..... 251/129.1
5,930,992 A * 8/1999 Esch et al. ..... 60/274
5,934,231 A * 8/1999 Schmitz et al. ..... 123/90.11
5,988,124 A * 11/1999 Duesmann ..... 123/90.11
6,044,814 A * 4/2000 Fuwa ..... 123/90.11
6,073,596 A * 6/2000 Kemper ..... 123/90.11
6,182,621 B1 * 2/2001 Salber et al. ..... 123/90.15
6,184,767 B1 * 2/2001 Pischinger et al. ..... 335/256
6,247,432 B1 * 6/2001 Pischinger et al. ..... 123/90.11

* cited by examiner

*Primary Examiner*—Joseph Pelham
*Assistant Examiner*—Fadi H. Dahbour
(74) *Attorney, Agent, or Firm*—Vanable; Norman N. Kunitz

(57) ABSTRACT

A method for operating a piston-type internal-combustion engine having electromagnetic valve trains for actuating the cylinder valves, which respectively have an armature that can move back and forth between two electromagnets, counter to the force of restoring springs, with the valves being completely variably actuated by an electronic engine timing control unit. The functioning of the electromagnetic valve trains of each cylinder is detected in the engine timing control unit during operation, and when a functional failure of an electromagnetic valve train is detected at a cylinder, the electromagnet of the failed electromagnetic valve train is acted upon with a capturing current, which brings the armature into an end position at an electromagnet, and from this end position, the electromagnetic valve train is actuated for the ongoing work cycle of the cylinder.

13 Claims, 1 Drawing Sheet

METHOD FOR OPERATING A PISTON-TYPE INTERNAL-COMBUSTION ENGINE IN THE EVENT OF A TEMPORARY FUNCTIONAL FAILURE OF AN ELECTROMAGNETIC VALVE TRAIN

CROSS REFERENCE TO RELATED APPLICATIONS

The present application claims the right of foreign priority of German Application No. DE 199 51 315.5 filed Oct. 25, 1999, the subject matter of which is incorporated herein by reference.

DESCRIPTION OF THE INVENTION

An electromagnetic valve train for actuating a cylinder valve in a piston-type internal-combustion engine essentially comprises two electromagnets, which are spaced from one another, and between which an armature that is connected to the cylinder valve can move back and forth, corresponding to the alternating supply of current to the electromagnets. In the respective end positions, i.e., when the armature rests against a pole face of one of the electromagnets, the associated cylinder valve is correspondingly located in its closed or open position. To capture the armature, the relevant electromagnet is acted upon with a higher, capturing current. As soon as the armature has reached its end position at the electromagnet, the supply of current to the electromagnet is reduced to a lower, retaining current.

Disturbances in the actuation of the current supply, such as a capturing current that is too low, or a retaining current that has been adjusted down too far, or the effect of external influences, can prevent the armature from coming into contact with the pole face, or cause it to detach prematurely from the pole face and, without further measures, move back into a central position between the two electromagnets due to the force of the restoring spring associated with the respective end position, so the affected cylinder valve remains in a half-open position. Because such actuators operate according to the resonance principle, that is, the full restoring force of the spring and the properly-timed activation of the capturing current at the other electromagnet are required for proper function, it is not possible to return the armature to the operating cycle with the normal control of the current supply to the electromagnets.

Aside from the fact that the piston-type internal-combustion engine operates with one less cylinder in the event of a failure of this cylinder valve, the failure of a cylinder valve severely hampers operation in spark-ignited, piston-type internal-combustion engines, which are typically provided with a catalytic exhaust-gas purification device. If one of the cylinder valves remains in the half-open position, both gas passages, that is, cylinder valves on the gas-intake side and the gas-outlet side, are open simultaneously over the course of further operating cycles, so air laden with unburned fuel or, when the injection is shut off, at least air enters the exhaust-gas tract, thereby skewing the values of the lambda control, which in turn leads to changes in the fuel supply that negatively impact the operation of the piston-type internal-combustion engine and effect an inadequate conversion of the catalytic converter. Furthermore, the vibrations in the suction or exhaust-gas system are changed by the failure of an actuator or cylinder.

It is the object of the invention to restart an electromagnetically-actuatable cylinder valve as quickly as possible following a functional failure during the operation of a piston-type internal-combustion engine.

SUMMARY OF THE INVENTION

To operate a piston-type internal-combustion engine with electromagnetic valve trains for actuating the cylinder valves, which respectively have an armature that can move between two electromagnets, counter to the force of restoring springs, and is connected to a cylinder valve, the valves being completely variably actuatable by an electronic engine timing, the invention proposes to accomplish the object through the detection of the function of the electromagnetic valve trains of each cylinder valve in the engine timing during operation. In particular, when a functional failure of a cylinder is ascertained, the electromagnet of the failed electromagnetic valve train is acted upon by a capturing current, which brings the armature into the end position at an electromagnet; and, from this end position, the electromagnetic valve train is actuated for the ongoing operating cycle of the cylinder.

To minimize the maximum current, the electromagnets of the individual electromagnetic valve trains are brought from the above-described half-open position into the fully-open position through the alternating supply of current at the resonant frequency of the spring-mass system comprising the armature, valve and restoring springs, or through the supply of a high current, for starting a piston-type internal-combustion engine. The starter can thus rotate the crankshaft practically without any compression resistance until the individual cylinder valves are moved into the open or closed position in the relevant sequence of the operating cycle due to the corresponding actuation of the associated electromagnetic valve trains, and the fuel supply and possibly the ignition is or are initiated.

If a functional failure occurs during ongoing operation, the injection is already activated, in contrast to the first oscillation buildup during starting, and a wall film of fuel is present in the intake passage. Furthermore, residual gas from the previous operating cycle is present in the cylinders, and the lambda control is activated, so measures must be implemented that have a small impact on the operation of the engine due to the actuator failure.

Because saving electrical energy is not an issue during ongoing operation, but remedying the functional failure of only one cylinder valve as quickly as possible is a focus, according to the invention, the engine timing actuates the electromagnet relevant for the next capturing process immediately after detecting the functional failure, or after recognizing a defect, it actuates the second-to-next capturing process with a correspondingly-high capturing current, so the armature is brought into one of its end positions against one of the pole faces of the capturing electromagnet in the shortest possible time. Depending on the work cycle of the relevant operating cycle, the valves are moved into the closed or open position in a defined manner, so the cylinder can either still be operated in an emergency mode, or if the valves are closed or partially closed, the cylinder can no longer be used for the power output, and exerts the smallest possible influence on the engine and catalytic-converter operation due to the switching of the other valves of the cylinder. From this end position, the current supply to the retaining electromagnet is controlled such that the relevant cylinder valve is moved again in the ongoing work cycle, or, in the case of a defective magnet, it is held in the end position.

Because a corresponding sensor assembly in the engine timing control unit can pinpoint the time of the failure relative to the operating cycle, the turn-on point for the capturing current specified for the piston movement can also be established with a corresponding programming of the electronic engine timing control unit, so the armature can be moved into the next open or closed position in the operating cycle in the shortest possible time. The actuation of the cylinder valves of the relevant cylinder must be changed in the engine timing control unit such that the valves of the one gas-conduction side (gas-intake side) and the other gas-conduction side (gas-outlet side) are not open simultaneously during a functional failure.

In an advantageous embodiment, it is provided that, during an ascertained functional failure, at least the fuel supply to the affected cylinder is cut off. Because inadequate compression keeps the affected cylinder from operating in the event of the failure of a cylinder valve, regardless of whether a gas-intake valve or gas-outlet valve fails, unburned fuel is prevented from being forced into the exhaust-gas tract and "overloading" the converter with hydrocarbons, because the lambda control additionally detects this operating situation as a "too lean" mixture, causing the fuel supply to the other, properly-functioning cylinders to be increased until the mixture in these cylinders is clearly too rich.

In an advantageous embodiment of the invention, it is further provided that the lambda control is deactivated when a functional failure is ascertained. The deactivation of the lambda control is also necessary when the engine timing cuts off the fuel supply to the affected cylinders, because the piston expels air supplied from the air-suction tract into the exhaust-gas tract as it continues to move, thereby increasing the oxygen component in the exhaust gas, which could, again, effect an increase in the fuel supply to the other, properly-functioning cylinders and not assure an optimum combustion process in the operating cylinders.

In a further embodiment of the method of the invention, it is provided that, if an intake-side cylinder valve fails, the cylinder valve(s) is (are) kept closed, or immediately closed, until the initiation of normal operation of the failed cylinder valve in the operating cycle, or an emergency mode for the failed cylinder or the engine. This prevents an unburned fuel-air mixture, or, if the fuel supply is cut off, air from being forced into the outlet tract.

In a modification, it is provided in the same manner that, when an outlet-side cylinder valve breaks down, at least one intake-side cylinder valve is opened to the upper dead-center position when the functional failure is recognized, and is held open or remains open, and in engines having at least two outlet valves, the other outlet valves are closed or held closed. The opening or closing procedure is effected outside of the normal operating cycle, depending on the time of the failure, so the intake-side cylinder valve is opened both during a piston movement in the expulsion phase and a piston movement in the compression phase to minimize the expulsion of the fuel-air mixture or air into the exhaust-gas tract. Both gas-intake valves are advantageously opened, so the majority of the gas volume is pressed into the air-suction tract and sucked back into the cylinder space because of the smaller free cross section of the only half-open, failed gas-outlet valve.

When the cylinder is switched back into the normal work cycle of the piston-type internal-combustion engine, it is advantageous to consider how much fuel from the operating cycles prior to and during the functional failure is present in the cylinder or the suction system in the metering of the quantity of fuel. The engine timing effects this metering as a function of whether a gas-intake or gas-outlet valve has failed, and at which point in a work cycle the failure occurred, i.e., whether the failure occurred during the air-suction and fuel-injection phase or during the exhaust-gas expulsion phase following a work cycle, or in the compression or expansion stroke. Another factor is the detection of the time of the functional failure with respect to the number of operating cycles, and the detection of the time of the fuel supply cutoff and the load and rpm status of the engine when the failure occurs and when the cylinder is switched back on.

When the engine timing control unit switches the cylinder on again, in addition to the quantity of fuel for the cylinder to be switched on, the load composition is to be adapted over the valve-control times. This adaptation depends on the extent to which burned exhaust gas is present, or could be present, in the cylinder, and to what extent a change has occurred in the marginal temperature conditions, depending on the functional failure time. Based on these marginal conditions, a decision must be reached on whether the present cylinder load is to be expelled into the exhaust-gas tract, or the load change can begin with a suction procedure.

In a further embodiment of the invention, it is provided that the time of the failure in the operating cycle is detected and stored for the purpose of error diagnosis for the affected cylinder.

The engine timing cannot ascertain whether a detected functional failure of a cylinder valve can be attributed to a temporary disturbance, such as an error in the current supply, or greater disturbing factors, etc., or the electromagnetic valve train itself has sustained permanent damage, such as a cable break or the like. A permanent error of this type can be recognized in that, in the supply of the electromagnetic valve train with current in accordance with the invention, the provided sensor assembly detects whether or not the affected valve train is operating properly again. After the valve-actuator failure has been identified, the valve control times and the valve-actuator control parameters of the affected cylinder must be adapted. In particular, the level of the outlet capturing current must be adapted when a failure occurs at a higher load in order to take into account the influence of the load on the current parameters. The altered suction-pipe and exhaust-gas dynamics can likewise necessitate an adaptation of the valve-actuator control parameters and the valve control times of the other cylinders, depending on the operating status of the engine.

In an embodiment of the method according to the invention, therefore, it is provided that, after an unsuccessful attempt to start up a cylinder valve on a gas-conduction side in the event of a sustained functional failure, the other gas-conduction side is held closed, and the engine timing actuates the cylinder valves and the fuel supply to the other cylinders for maintaining the total load output with a correspondingly higher load presetting. This ensures that the proportion of the load of the failed cylinder is completely assumed by the other cylinders. To avoid excessive rotation uniformity, which could decrease the driving comfort, when the load of the cylinders that are still being fired is increased, one or more cylinders can be shut off correspondingly. This can be effected such that, after the cutoff of the fuel supply and ignition, the cylinder valves are held closed on one gas-conduction side, and held open on the other gas-conduction side, or they are all closed. The remaining cylinders can also be fired alternatingly by cycle.

The invention is described in detail in conjunction with the drawing.

BRIEF DESCRIPTION OF THE DRAWINGS

The FIGURE is a cylinder of an internal-combustion engine used for carrying out the method according to the invention.

DETAILED DESCRIPTION OF THE PREFERRED EMBODIMENTS

Figure 1:
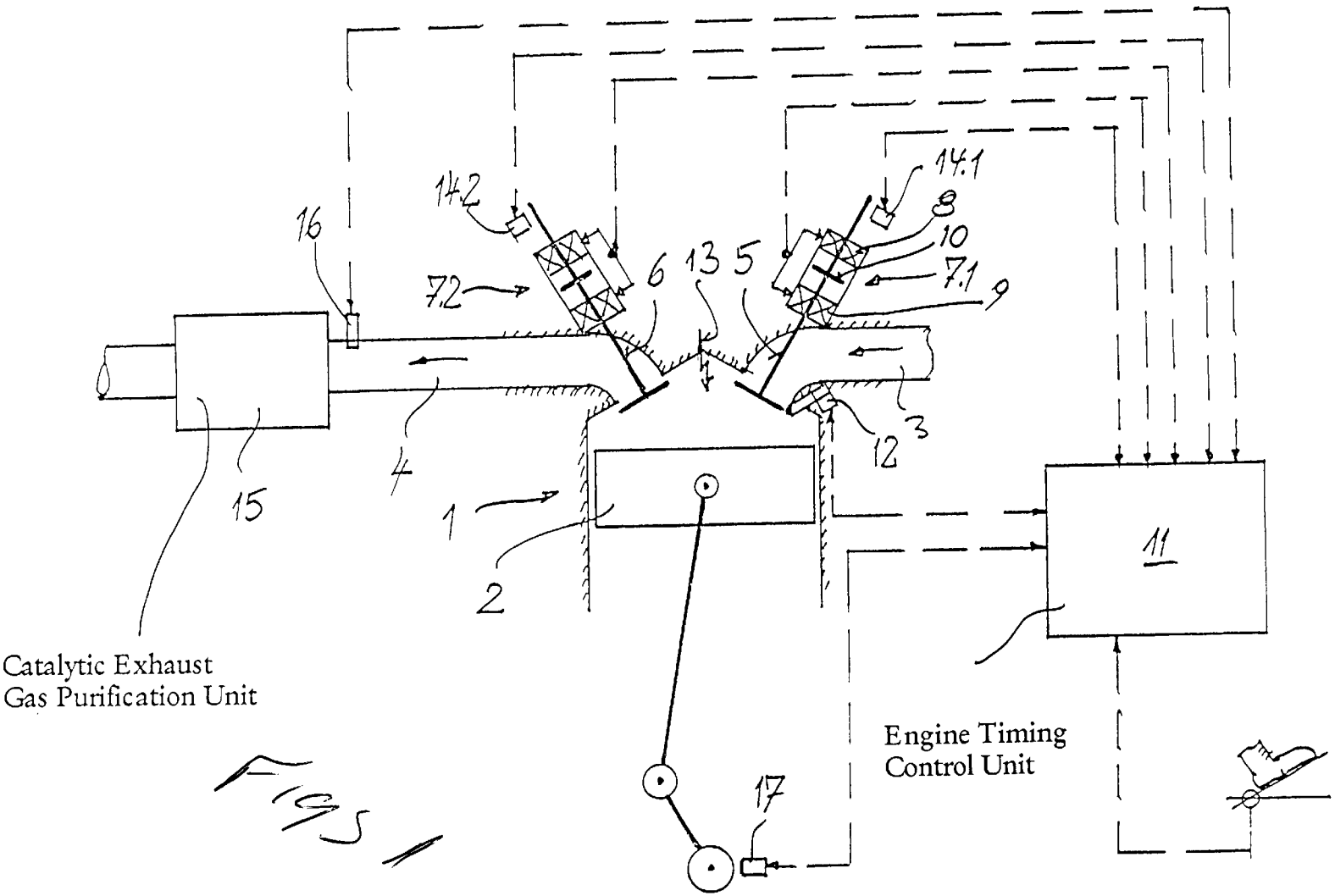

The FIGURE schematically illustrates a cylinder 1 of a piston-type internal-combustion engine, in which a piston 2 moves up and down in a conventional manner between the upper and lower dead centers. Each of the cylinders 1 of the piston-type internal-combustion engine is provided on one gas-conduction side with a gas-intake passage 3, and on the other gas-conduction side with a gas-outlet passage 4, with a gas-intake valve 5 and a gas-outlet valve 6 respectively being associated with the passages 3 and 4. At a minimum, one cylinder valve 5 is provided with a respective electromagnetic valve train 7.1 and 7.2. The electromagnetic valve train 7 essentially comprises a closing magnet 8 and an opening magnet 9, between which an armature 10 can move back and forth in a known manner, counter to the force of restoring springs, not shown in detail here. The armature 10 is connected to the associated cylinder valve, so when the armature 10 comes to rest against the closing magnet 8, the cylinder valve is closed, and when the armature 10 comes to rest against the opening magnet 9, the cylinder valve is completely open. If the two electromagnets 7 and 8 are currentless, the armature 10 and, correspondingly, the associated cylinder valve assume a half-open intermediate position without further mechanical fixing measures.

The supply of current to the magnets 8 and 9 of the electromagnetic valve trains 7 is actuated via an engine timing control until, which also controls the other functions of the piston-type internal-combustion engine, such as the fuel supply, which is schematically represented here by a direct-injection fuel nozzle 12, and the ignition, which is represented by a corresponding lightning symbol 13.

Associated with the two electromagnetic valve trains is a sensor assembly for detecting the valve or armature movement, the assembly being schematically represented here by sensors 14.1 and 14.2, which are in operational connection with the cylinder valve. The valve movement can also be detected with other means, such as a detection of the current and/or voltage courses at the electromagnets directly supplied by the engine timing control unit, because it is known that the current course and the voltage course in a coil change when the magnetic field is changed by an armature that is not in contact, is approaching, is in contact or is moving away.

The exhaust-gas tract 4 of the piston-type internal-combustion engine, which is shown here with only one cylinder, is connected to a catalytic exhaust-gas purification device 15, for example a three-way exhaust-gas converter, which has an associated lambda sensor 16 for influencing the fuel supply.

In accordance with the method described in detail above, when a functional failure of, for example, the cylinder valve occurs, the engine timing control unit 11 reacts immediately. The fuel supply to this cylinder is cut off by the closure of the fuel-injection valve 12, and the gas-outlet valve 6 is held closed to prevent air or an unburned air-fuel mixture from being expelled from the cylinder space into the exhaust-gas tract via the gas-intake valve, which is in the open state.

As soon as the gas-intake valve 5 has been brought into the corresponding end position at its retaining electromagnet 8 or 9, the two electromagnetic valve trains 7.1 and 7.2 are actuated corresponding to the work cycle specified for this cylinder for the entire piston-type internal-combustion engine, and the ignition and fuel supply are also re-initiated corresponding to the associated work cycle. If a magnet is defective, measures are likewise implemented—depending on whether the magnet is an opening or closing magnet—for continuing to operate the engine with the least possible influence on the operating behavior.

The further measures to be implemented in connection with restarting a failed cylinder valve, which are also a function of whether a gas-intake valve or a gas-outlet valve has failed, were described above. To avoid repetition, the different operating situations are not further described here in conjunction with the schematic drawing.

The invention now being fully described, it will be apparent to one of ordinary skill in the art that many changes and modifications can be made thereto without departing from the spirit or scope of the invention as set forth herein.

We claim:

1. A method for operating a piston-type internal-combustion engine having electromagnetic valve trans for actuating the cylinder valves, said valve trains respectively have an armature that can move back and forth between two electromagnets, counter to the force of restoring springs, with the valves being completely variably actuated by an electronic engine timing control unit, said method comprising: detecting the function of the electromagnetic valve trains of each cylinder in the engine timing control unit during operation; when a functional failure of an electromagnetic valve train is detected at a cylinder, supplying the respective electromagnet of the failed electromagnetic valve train with a capturing current that brings the armature into an end position at one of the electromagnets; then, from this end position, actuating the electromagnetic valve train for the ongoing work cycle of the respective associated cylinder; and during the time of a functional failure of a cylinder valve, actuating the remaining cylinder valves of the associated cylinder such that gas-intake side and gas-outlet side of the associated cylinder are not open simultaneously.

2. The method according to claim 1 further comprising: during the time of a functional failure, cutting off at least the fuel supply to the associated cylinder.

3. The method according to claim 1 further comprising: for a piston-type internal-combustion engine having a lambda control, deactivating the lambda control during the time of a function failure.

4. A method for operating a piston-type internal-combustion engine having at least two cylinder valves, on the gas-intake side and on the gas-outlet side, respectively, according to claim 1 further comprising: when an intake-side cylinder valve fails, holding the outlet-side cylinder valves of the cylinder closed until normal operation or emergency operation of the failed cylinder valve has been initiated in the work cycle.

5. The method according to claim 4, further comprising: when an outlet-side cylinder valve fails, opening at least one intake-side cylinder valve at the upper dead center, and held open, in a piston movement, and holding the at least one intake-side cylinder valve open.

6. The method according to claim 5, wherein the closed cylinder valve remains closed and the engine continues to operate with one valve on the gas-intake or gas-outlet side.

7. The method according to claim 6, further comprising shutting off at least one further cylinder, and the engine can therefore be operated with the same ignition interval, and the cylinders can be shut off alternatingly.

8. The method according to claim 1, further comprising: during a re-start of the failed cylinder valve, taking into consideration the time of a failure in the operating cycle, the load, rpm and duration or the operating cycles of the failure for actuating the fuel supply for the ongoing work cycle.

9. The method according to claim 8, further comprising: after an unsuccessful attempt to start up a cylinder valve on a gas-conduction side of the cylinder, in the event of a sustained functional failure, holding the other gas-conduction side closed, and causing the engine timing control unit to actuate the cylinder valves and the fuel supply to the other cylinders to maintain a total load output with a correspondingly higher load presetting.

10. The method according to claim 9, wherein the entire load output remains constant through the adaptation of the load of the cylinders.

11. The method according to claim 9, wherein the load composition is adapted during the re-start of the cylinder.

12. The method according to claim 1, further comprising: detecting and storing the time of a failure in the operating cycle for the purpose of error diagnosis for the affected cylinder.

13. A method for operating a piston-type internal-combustion engine having at least two cylinder valves, on the gas-intake side and on the gas-outlet side, respectively, according to claim 1 further comprising: when an outlet-side cylinder valve fails, opening at least one intake-side cylinder valve at the upper dead center in a piston movement, and holding the at least one intake-side cylinder valve open.

* * * * *